United States Patent [19]

Huff

[11] 4,414,936

[45] Nov. 15, 1983

[54] CHECK VALVE CYLINDER DEACTIVATION

[76] Inventor: Craig W. Huff, 12307 Swinbrook, Houston, Tex. 77039

[21] Appl. No.: 345,779

[22] Filed: Feb. 4, 1982

[51] Int. Cl.[3] ..... F02D 13/06

[52] U.S. Cl. ..... 123/198 F; 123/DIG. 1; 123/DIG. 7; 123/1 R

[58] Field of Search ..... 123/198 F, DIG. 1, DIG. 7, 123/DIG. 6, 1 R

[56] References Cited

U.S. PATENT DOCUMENTS

| | | | |
|---|---|---|---|
| 3,874,358 | 4/1975 | Crower | 123/DIG. 7 |
| 3,885,387 | 5/1975 | Simington | 123/DIG. 7 |
| 3,945,367 | 3/1976 | Turner | 123/DIG. 7 |
| 4,018,204 | 4/1977 | Rand | 123/198 F |
| 4,070,971 | 1/1978 | Studebaker | 123/198 F |
| 4,096,845 | 6/1978 | Helmes | 123/198 F |
| 4,105,010 | 8/1978 | Rand | 123/198 F |
| 4,191,152 | 3/1980 | Deutschmann | 123/198 F |
| 4,207,855 | 6/1980 | Phillips | 123/198 F |

*Primary Examiner*—Ira S. Lazarus

*Attorney, Agent, or Firm*—Bernard A. Reiter

[57] ABSTRACT

A system for deactivating cylinders in an interval combustion engine by replacing the spark plugs in every other cylinder of the firing order of the engine with a check valve grounding the unused spark plug wire to the engine, disconnecting the valve activating means in the deactivated cylinders so that the engine capacity is reduced thus reducing fuel consumption.

5 Claims, 4 Drawing Figures

CHECK VALVE CYLINDER DEACTIVATION

BACKGROUND OF THE INVENTION

This invention relates to internal combustion engines and in particular to reducing fuel consumption of internal combustion engines by deactivating cylinders in the engine thus converting the engine to run on less cylinders than it was designed for by deactivating the valves and valve actuating means and substituting a check valve for the spark plug in the cylinders deactivated.

In most United States made internal combustion V-8 engines, the carburetor and intake manifold are constructed so that the engine is two V-4 engines interspaced with each other. In some engines, the firing order of the cylinders is 1-8-4-3-65-7-2. Cylinders 1-4-6-7 constitute a four cylinder engine and these cylinders are fed gasoline from one side of the carburetor. Cylinders 8-3-5-2 constitute another four-cylinder engine and these cylinders are fed gasoline from the other side of the carburetor. V-8 engines with other firing orders are arranged in a similar way. To convert the engine to run on less cylinders, the cylinders to be deactivated must be one of the sets that make up a four cylinder engine. This will be every other cylinder in the firing order of the engine. For example, to convert a V-8 engine with a firing order of 1-8-4-3-6-5-7-2 into a V-4 engine by deactivating cylinders, the cylinders that must be deactivated are cylinders 8-3-5-2 or cylinders 1-4-6-7.

Methods of reducing fuel consumption of internal combustion engines by deactivating cylinders are in the prior art. Typical of these are disclosed in U.S. Pat. Nos. 3,874,358; 3,945,367; 4,105,010; and 4,070,971.

U.S. Pat. No. 3,874,358 discloses a method of deactivating the cylinders of an internal combustion engine by replacing the pistons with hollow piston substitutes. This method requires a major disassembly of the engine to replace the pistons which is tantamount to a major overhaul.

U.S. Pat. No. 3,945,367 discloses another method of deactivating cylinders of an internal combustion engine by removing the spark plugs of the cylinders to deactivate it and connecting a conduit between the spark plug hole for each such cylinder in the carburetor air-cleaner. However, this method permits the free movement of air into and out of the cylinders, thereby requiring energy to be lost due to the pumping action of the pistons in each cylinder.

U.S. Pat. No. 4,105,010 discloses an apparatus for reducing the fuel flow into certain cylinders of a multi-cylinder engine by using an additional, unthrottled intake valve to admit air to the cylinders, thereby creating a leaner fuel mixture under certain conditions. This method requires a sophisticated modification of the engine.

U.S. Pat. No. 4,070,971 discloses deactivating cylinders of an internal combustion engine by disconnecting and removing pistons and adding counterweights on the crankshaft and fly-wheel. This method requires the disassembly of the entire engine which is tantamount to a major overhaul.

None of the disclosed references show or provide a simple and inexpensive method of deactivating cylinders in an internal combustion engine by substituting a check valve for the spark plug, and utilizing the pneumatic spring concept in reducing the loss of energy.

SUMMARY OF THE INVENTION

Check valve cylinder deactivation, as described herein, consists of modifying selective cylinders of an internal combustion engine so that these cylinders are taken out of service. This is accomplished by removing the push rods that activate the cylinder valves, removing the spark plug, and replacing same with a check valve, and grounding the unusued spark plug wire to the engine. Since the cylinder valves are inoperative, no gasoline-air mixture is fed to the deactivated cylinder and no combustion would occur in the combustion chamber of the cylinder. The check valve permits air to enter the combustion chamber, but does not allow air to escape therefrom. As the piston moves down in its downward or vacuum stroke, air enters the combustion chamber by means of the check valve. As the piston moves up on its compression stroke, air is not allowed to escape through the check valve. After a few cycles of the piston, the combustion chamber becomes charged with air. As the piston moves up on its compression stroke, this air in the combustion chamber becomes compressed and takes on the nature of a pneumatic spring. The energy used in compressing the air by the piston is returned to the engine on its downward stroke. The cylinder is thus effectively taken out of service with a very minor modification of the cylinder and some of the work or energy used by the engine in moving the piston is is returned to the engine by the compressed air as the air expands on the downward or vacuum stroke of the piston.

The primary object of this invention is to reduce the gas consumption of an internal combustion engine by providing a simple, inexpensive method of deactivating cylinders requiring no major mechanical or electrical modifications.

Another object of this invention is to return some of the work or energy used in the compression stroke of the piston back to the engine on the vacuum stroke, of the piston, thus preserving energy by the use of the pneumatic spring principle.

An important feature of this invention is that since the modification is simple, the cost of such modification should be minimal.

Other objects and advantages of this invention will become apparent from the following description taken in connection with the accompanying drawings wherein are set forth, by way of illustration and example, certain embodiments of this invention.

DESCRIPTION OF THE PREFERRED EMBODIMENT

Figure 1:
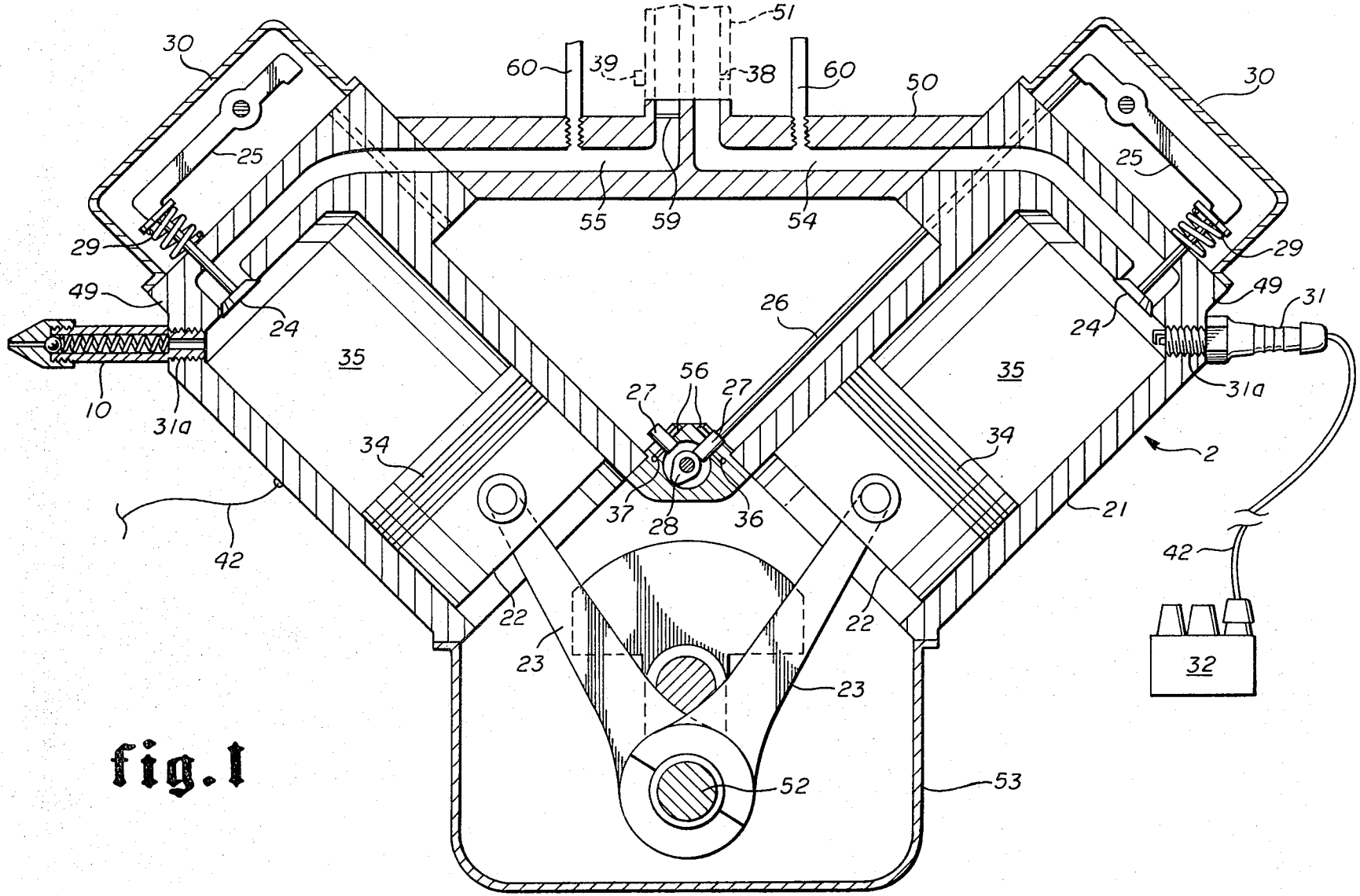
FIG. 1 is a cross-sectional view of a V-eight engine showing one deactivated and one regular cylinder.

Referring to FIG. 1, (right side) a cylinder of a typical internal combustion engine is illustrated generally as reference numeral 2, comprising as the main components a cylinder wall 21, a piston 22, a connecting rod 23, a cylinder valve 24, a rocker arm 25, a push rod 26, a valve lifter 27, a cam shaft 28, a cylinder valve spring 29, a cylinder valve cover 30, a spark plug 31, a distributor 32, a spark plug wire 42, running from the distributor 32 to the spark plug 31, piston rings 34, a combustion chamber 35, oil feed lines 36, and gasoline feed lines 38, cylinder head 49, intake manifold 50, carburetor 51, crank shaft 52, oil pan 53 and air passage 54, cylinder valve lifter clamp 56.

Figure 2:
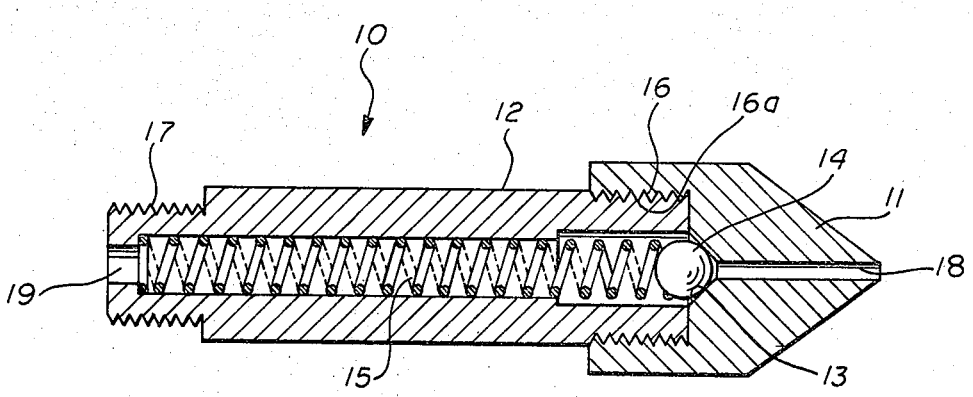
FIG. 2 is a cross-sectional view of a check valve according to the present invention.

Referring to FIG. 2, a check valve 10, according to the present invention is illustrated comprising a valve cap 11, a valve body 12, a valve seat 13, a valve ball 14, a valve spring 15, threads 16 on one end of the valve body 12, threadably engaging similar and matching threads 16*a* in the valve cap 11. On the other end of the valve body 12, are threads 17, sized to threadably engage and match the existing threads 31*a* in the cylinder head wall 49. Threads 17 on the valve body 12 are sized to threadably engage with the existing spark plug threads 31*a* for a conventional spark plug.

Referring to FIG. 1 (left side) the conversion of the cylinder is illustrated. Spark plug 31 is removed and the check valve 10 is threadably engaged into the cylinder head wall 49, through the existing spark plug opening. Push rod 26 is removed and spark plug wire 42 is grounded to the engine block. The oil feed line 36 is plugged with a plug 37, and the gasoline feed line 38 is plugged with the plug 39. Air passage 55 is plugged with a seal 59 and a cross over connection 60 is made to the air passage side 54 still in service so as to maintain vacuum in the unused air passage 55 that might be utilized by some of the items on the vehicle that are activated by vacuum, such as power brakes, etc. Lifter 27 is secured in place a little above its normal position with high temperature epoxy glue or set screw 56. The clamping of the lifter 27 a little above its normal position prevents the loss of oil and oil pressure. In some engines, other oil passages will have to be plugged to prevent the loss of oil pressure and oil.

Figure 3:
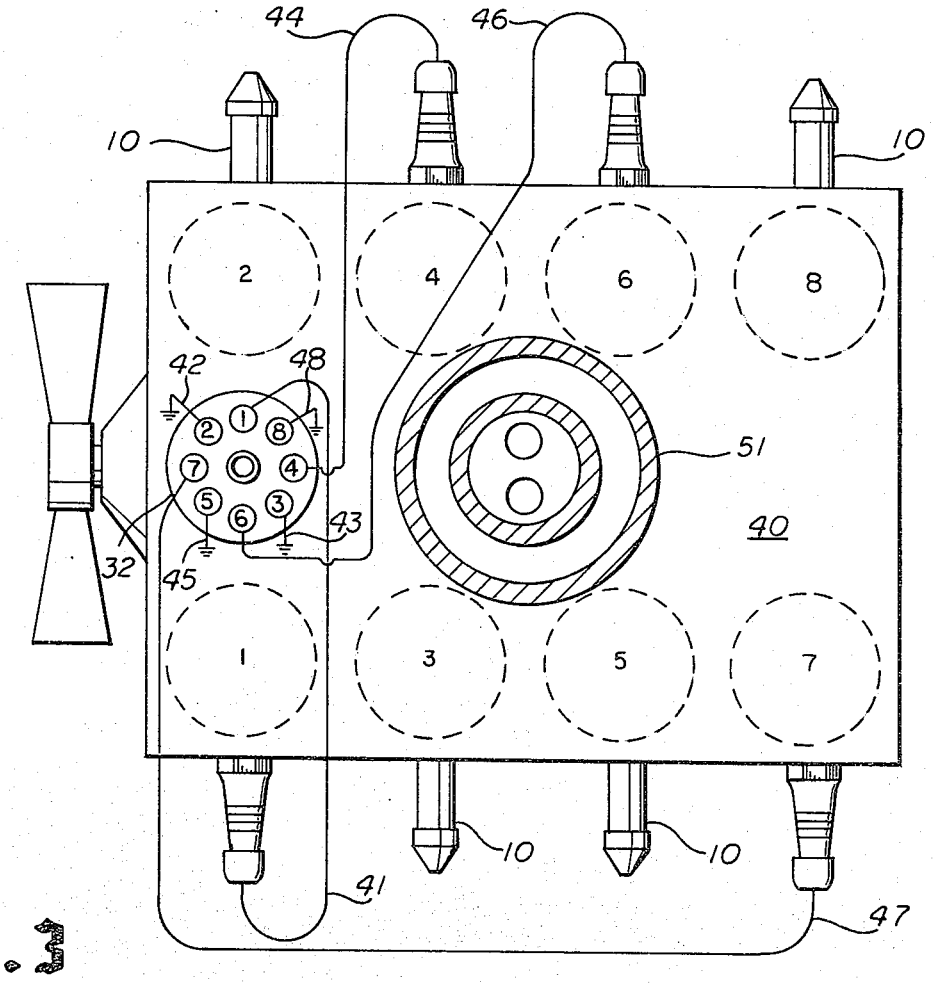
FIG. 3 is a schematic representation of an engine block showing the selective cylinders deactivated.

The cylinders selected to be modified are every other cylinder in the firing order. For instance, if the firing order of the engine is 1-8-4-3-6-5-7-2, the cylinders to be deactivated will be 8-3-5-2. This is illustrated in FIG. 3 whereby the spark plugs are removed and the check valve 10 is installed in cylinders 8, 5, 3, 2 respectively. The spark plug wires to each of these cylinders 48, 45, 43, and 42 are grounded to the engine block as illustrated or can be brought together and grounded through a 100 obm, 10 watt resistor.

Figure 4:
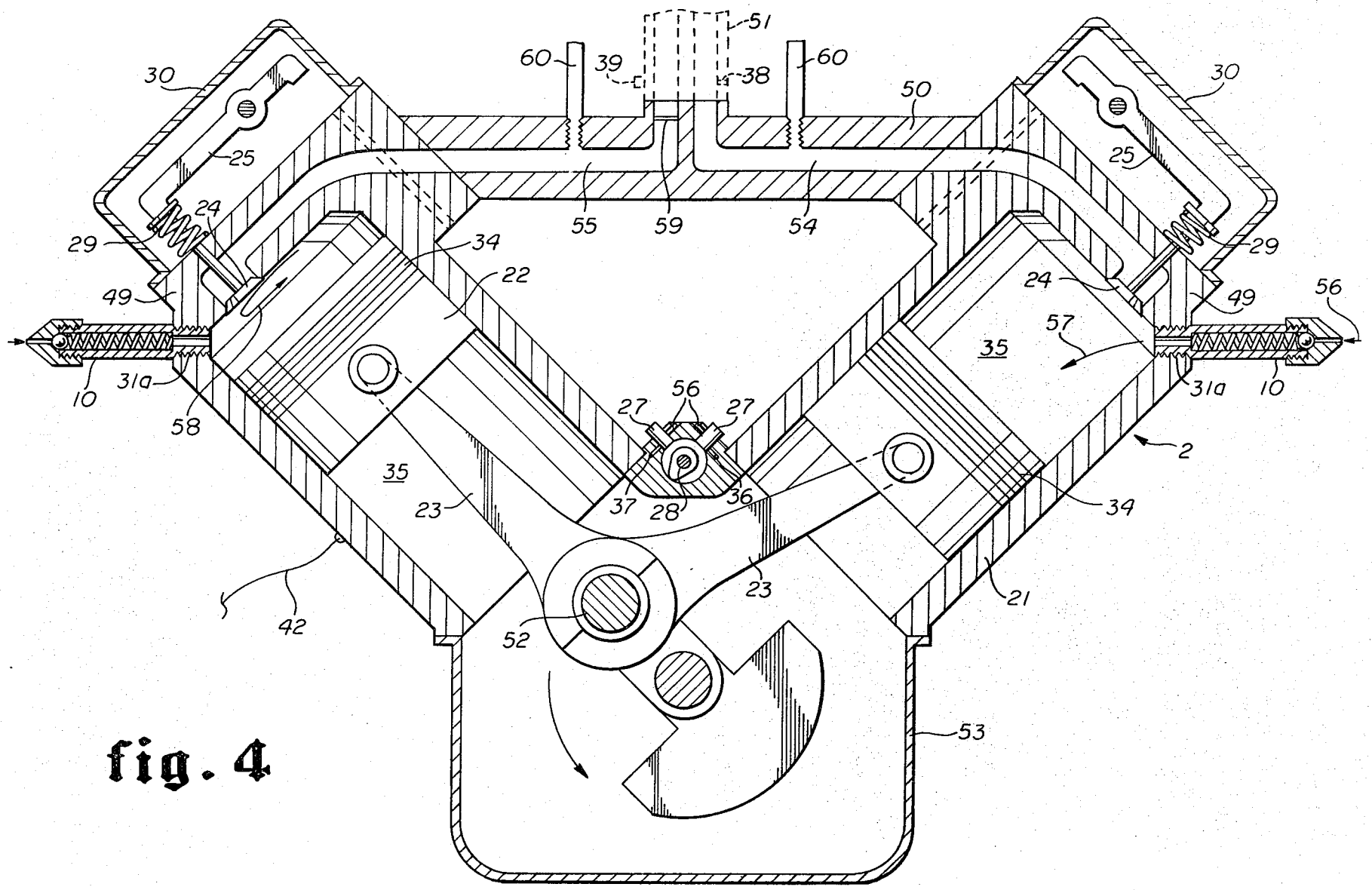
FIG. 4 is a cross-sectional view of a V-eight engine showing two deactivated cylinders.

FIG. 4 illustrates the method of operation of the cylinder deactivation by means of the check valve 10. Referring to FIG. 4 (right side), when the piston 22 is on its downward or vacuum stroke, air is allowed to enter the combustion chamber 35 through the check valve 10, as shown by arrows 56 and 57. When the piston 22 is on its downward stroke, a vacuum is pulled, thus disengaging the valve ball 14 from the valve seat 13, and compressing the valve spring 15. This allows air to be pulled in through the orifice 18, around the valve ball 14, and through the spring 15, thus entering the combustion chamber 35. In FIG. 4, (left side) the piston 22 is on its compression stroke. Valve ball 14 is forced against the valve seat 13 in sealing engagement, thus preventing air from escaping through the orifice 18. Air is thus trapped in the combustion chamber 35, as illustrated by arrow 58 and is compressed. After a few revolutions, no more air will enter or leave the combustion chamber 35. When the piston 22 is on its compression stroke, as illustrated in FIG. 4, (left side) the air in the combustion chamber 35 becomes compressed and begins to act like a pneumatic spring. The energy used in compressing this air is returned to the engine when the piston 22 begins its downward stroke. The basic principle used in this invention is the use of the pneumatic spring principle when compressing air. All of the energy, of course, will not be recovered due to the friction losses, however, some of the energy used in compressing the air in the combustion chamber 35 is returned to the engine when the piston begins its downward stroke by the compressed air expanding. When the engine is turned off, the compressed air in the combustion chamber 35 is allowed to escape into the crankcase by passing around the piston rings 34 of the piston 22 and vented in the normal manner.

This cylinder deactivation by means of a check valve has distinct advantages in that no sophisticated major modifications of the engine need to be performed. More important, by use of the pneumatic spring principle, some of the energy used in compressing the air by the movement of the piston is returned to the engine when the piston begins its downward stroke.

While the invention has been described with reference to a preferred embodiment, it will be obvious to one skilled in the art that modifications and variations of the invention may be constructed and employed without departing from the scope of the invention. The scope of the invention is defined in the following claims.

I claim:

1. In a multi-cylinder internal combustion engine, in which each cylinder has a piston, a spark plug, valves and valve actuating means, the improvement comprising:

a check valve replacing the spark plug in alternate cylinders in the firing order of the engine, each check valve having engaging threads on one end to match the existing threads in the cylinder wall after removal of the spark plug;

and the valve actuating means in the said alternate cylinders being disconnected.

2. The structure of claim 1, wherein said check valve further comprises:

a cylindrical valve body having an internal cylindrical hollow void;

a valve cap threadable engaging one end of said valve body having an orifice through said valve cap;

a valve seat in said valve cap with said orifice extending through said valve seat;

compression means within said internal cylindrical hollow void;

a valve ball located at one end of said compression means and pressed against said valve seat in said valve cap by said compression means so arranged that when said compression means compresses, said valve ball will move away from said valve seat allowing air to enter said check valve through said orifice and on relaxing said compression means, said valve ball will engage said valve seat in sealing arrangement not allowing air to escape through said orifice.

3. The structure of claim 1, wherein:

the valve actuating means includes a push rod to each valve and a cam actuated lifter connected to each push rod; the improvement further comprising removing said push rod.

4. In a multi-cylinder internal combustion engine in which each cylinder has a piston, a spark plug, spark plug wire, an intake manifold, vacuum lines, oiland gas feed lines, valves and valve activating means, the method of deactivating cylinders converting the engine to a smaller capacity, comprising:

removing the spark plug and spark plug wire from alternate cylinders in the firing order of the engine and installing in their place check valves allowing air to enter the cylinder when the piston is on its downward stroke and preventing air from leaving the cylinder when the piston is on its upward stroke;

disconnecting the valve actuating means in the said alternate cylinders;

connecting the spark plug wires removed from each spark plug to the engine, thus providing a short circuit to ground;

plugging all gasoline feed lines to said alternate cylinders thus preventing a combustion mixture from entering said cylinders;

transferring the vacuum hoses from that side of the intake manifold that went to the said alternate cylinders to the other side of the intake manifold to maintain full vacuum.

5. The method of claim 4, wherein the valve actuating means includes a push rod and a cam actuated valve lifter for actuating each valve, and including the step of:

removing the push rod from each valve in the said alternate cylinders;

securing the valve lifter in place.

* * * * *